US010010779B2

(12) United States Patent
Goldberg

(10) Patent No.: US 10,010,779 B2
(45) Date of Patent: Jul. 3, 2018

(54) SURFBOARD PADDLING EXERCISE APPARATUS

(71) Applicant: James Jordan Goldberg, Carmel, CA (US)

(72) Inventor: James Jordan Goldberg, Carmel, CA (US)

( * ) Notice: Subject to any disclaimer, the term of this patent is extended or adjusted under 35 U.S.C. 154(b) by 222 days.

(21) Appl. No.: 14/886,021

(22) Filed: Oct. 17, 2015

(65) Prior Publication Data

US 2017/0106264 A1 Apr. 20, 2017

(51) Int. Cl.

| | |
|---|---|
| ***A63B 69/10*** | (2006.01) |
| ***A63B 69/00*** | (2006.01) |
| ***A63B 21/008*** | (2006.01) |
| ***A63B 21/055*** | (2006.01) |
| ***A63B 21/00*** | (2006.01) |
| ***A63B 22/00*** | (2006.01) |
| ***A63B 23/12*** | (2006.01) |

(52) U.S. Cl.

CPC ..... *A63B 69/0093* (2013.01); *A63B 21/008* (2013.01); *A63B 21/0552* (2013.01); *A63B 21/153* (2013.01); *A63B 21/4035* (2015.10); *A63B 22/0002* (2013.01); *A63B 23/1245* (2013.01)

(58) Field of Classification Search

CPC ..... A63B 21/008; A63B 21/0083; A63B 21/0085; A63B 21/0087; A63B 21/02; A63B 21/0407; A63B 21/0428; A63B 21/0552; A63B 21/15; A63B 21/151; A63B 21/153; A63B 21/154; A63B 21/156; A63B 21/158; A63B 21/4035; A63B 22/0002; A63B 22/0076; A63B 23/1245; A63B 69/0093; A63B 69/06; A63B 2069/062

See application file for complete search history.

(56) References Cited

U.S. PATENT DOCUMENTS

| | | | | | |
|---|---|---|---|---|---|
| 679,784 | A * | 8/1901 | Ryan | A63B 21/1654 | 267/73 |
| 4,480,832 | A * | 11/1984 | Bulmash | A63B 21/0004 | 188/321.11 |
| 4,685,670 | A * | 8/1987 | Zinkin | A63B 21/04 | 482/129 |
| 4,921,242 | A * | 5/1990 | Watterson | A63B 21/0083 | 482/121 |
| 6,142,919 | A * | 11/2000 | Jorgensen | A63B 21/055 | 482/121 |
| 7,862,489 | B2 * | 1/2011 | Savšek | A63B 21/0455 | 482/121 |
| 7,887,468 | B2 * | 2/2011 | Ross | A63B 21/055 | 482/92 |

(Continued)

*Primary Examiner* — Joshua Lee

(57) ABSTRACT

The invention is an exercise apparatus providing an advanced level of surfboard paddling simulation and muscle development. The design includes a specialized platform, unique hand harnesses, and cable systems with mechanical advantage and mass moment of inertia mechanisms, piston pumps, cable spools, and elastic elements. They allow the user to simulate paddling in an alternating or simultaneous sequence at any speed while strong elastic tension resists the user's thrust strokes, but during paddling return strokes the user feels no elastic tension or resistance. The design also prompts the user to engage and strengthen all dorsal muscles to maintain an appropriately arched body position while paddling.

10 Claims, 13 Drawing Sheets

(56) References Cited

U.S. PATENT DOCUMENTS

| | | | | |
|---|---|---|---|---|
| 2004/0138033 | A1* | 7/2004 | Van Straaten | A63B 21/00065 482/112 |
| 2004/0254050 | A1* | 12/2004 | Morgan | A63B 21/00072 482/122 |
| 2005/0233868 | A1* | 10/2005 | Mills | A63B 22/0076 482/72 |
| 2006/0100074 | A1* | 5/2006 | Murdoch | A63B 21/055 482/142 |
| 2013/0157823 | A1* | 6/2013 | Gilman | A63B 21/00 482/139 |
| 2016/0107023 | A1* | 4/2016 | Campanaro | A63B 22/0087 482/72 |

* cited by examiner

SURFBOARD PADDLING EXERCISE APPARATUS

BACKGROUND OF THE INVENTION

Field of the Invention

The present invention relates to exercising machines, particularly to exercise machines of the type using yielding elastic elements.

Description of the Related Art

There are numerous exercise machines available to develop the muscle groups needed for performing particular sports activities. However, there has been no exercise machine available to effectively develop the unique combination of muscle groups needed when paddling on a surfboard while surfing. That is because paddling while surfing requires more than just stroking one's arms through the water to thrust the surfboard forward. It also requires the strength and coordination to raise and hold the shoulders and upper chest and both legs upward, and well above the deck of the surfboard while paddling. The reason for arching the shoulders upward in that manner while paddling, is so that each arm can be lifted completely out of even very choppy water to avoid dragging the arm through the water while swinging it forward during each paddling return stroke. Accordingly, a surfboard paddling exercise machine should develop all of the dorsal muscles needed to raise the shoulders upward while paddling. Furthermore, to simulate the absence of any drag on the arm through the water during paddling return strokes, the machine should first provide a full measure of muscle developing paddling resistance during the user's thrust strokes, but then offer zero tension or resistance to the user's arm motions during return strokes. Additionally, the exercise machine should allow the user to simulate paddling with both arms simultaneously, or with each arm in an alternating sequence, or in any variation thereof, and at any typical paddling speed just as when surfing. The present invention is an advancement over prior art in that it does fulfill all of those requirements to develop the full range of muscular strength for paddling that surfing demands.

BRIEF SUMMARY OF THE INVENTION

A preferred example of the present invention provides a horizontal platform that the user lays upon as when paddling on a surfboard. The top surface of the platform includes a raised section that is just large enough to support the user's lower torso and upper legs. That torso support design prompts the user to hold the shoulders and upper chest and legs up above the surrounding top surfaces of the platform while the user simulates surfboard paddling thrust strokes by pulling down and back on specialized hand harnesses. The right and left hand harnesses allow the user to cup the hands just as when paddling a surfboard, and they are connected to the unique cable systems of the invention. The cable systems use a combination of mechanisms and elastic cords to fully resist the user's thrust strokes, which strokes can be in an alternating or simultaneous sequence, or in any variation thereof. Then, during the user's return strokes, and at any paddling speed, the cable systems are able to automatically fully return each hand harness back to its original starting position with just enough time delay, relative to the user's arm motions, that the existing elastic cord tension seemingly disappears to the user. That mechanical capability provides not only a very accurate paddling simulation, but also allows the user's arms to be raised above the shoulder level on the return strokes without causing discomfort or strain on the user's shoulder and elbow joints that could otherwise be caused by the strong tension and resistance from the elastic cords.

1—platform
2—hinged front leg assembly
3—hinged rear leg assembly
4—right hand and left hand harness
5—torso support
6—cable leading segment
7—outboard pulley
8—inboard pulley
9*a*—spool axle bolt
9*b*—axle bolt lock nut
9*c*—axle bolt cap nut
9*d*—spool retaining nut
9*e*—axle bolt washers
10*a*—spool hub
10*b*—spool top disc

10*c*—spool machine screw
10*d*—machine screw lock nut
11*a*—cable spool weight
11*b*—weight mounting screw
12—spool bottom disc
13*a*—block set of pulleys
13*b*—tackle set of pulleys
14—cable trailing segment
15—forward yoke
16—piston pump rod
17—piston pump
18—pump hose
19—relief valve
20—primary elastic cord
21—rearward yoke
22—elastic cord adjustment rod
23—rearward yoke pulley
24—elastic cord fixed anchor
25—gear racks
26—rack guide mount screw
27—spool bracket
28—cable to primary cord link
29—elastic cord movable anchor
30—elastic cord transom pulley
31—pinion gear
32—gear rack guide
33—gear rack bearing insert
34—gear rack guide mounting bracket
35—tilting plate
36—tilting plate axle
37—tilting plate to axle strap
38—axle to platform strap
39—tilting plate spring
40—pump crossbar strap
41—pump crossbar
42—adjustment inspection slot
43—elastic cord adjustment crank
44—trailing cable end stop
45—secondary cable to cord link
46—secondary elastic cord
47—secondary cord anchor
48—secondary cord pulley
49—air valve adjustment dial

DETAILED DESCRIPTION OF THE PREFERRED EMBODIMENTS

Figure 1:
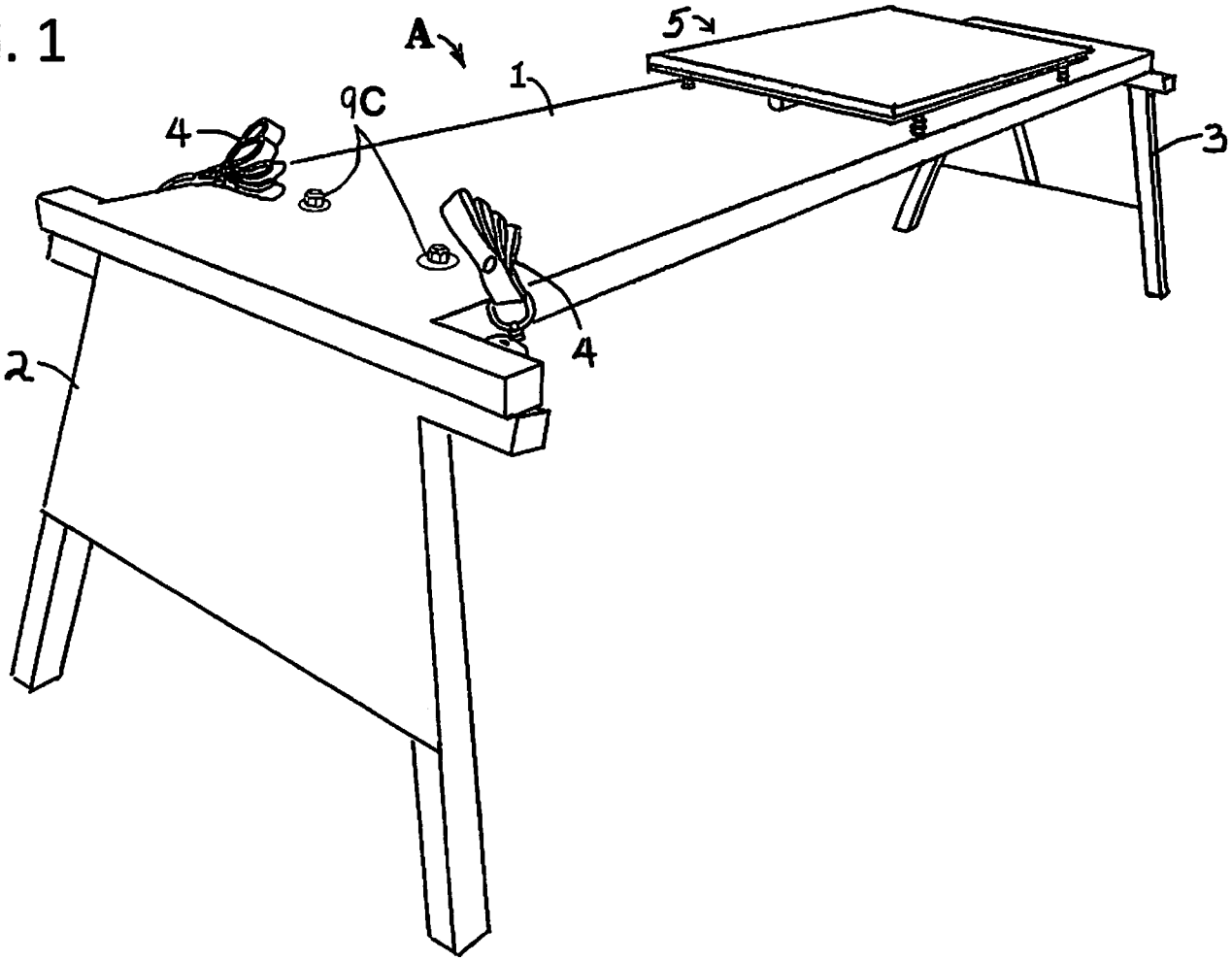
FIG. 1 is a general perspective view of the front, left side, and top surfaces of an exercise apparatus A configured in accordance with an embodiment of the present invention.
Figure 10:
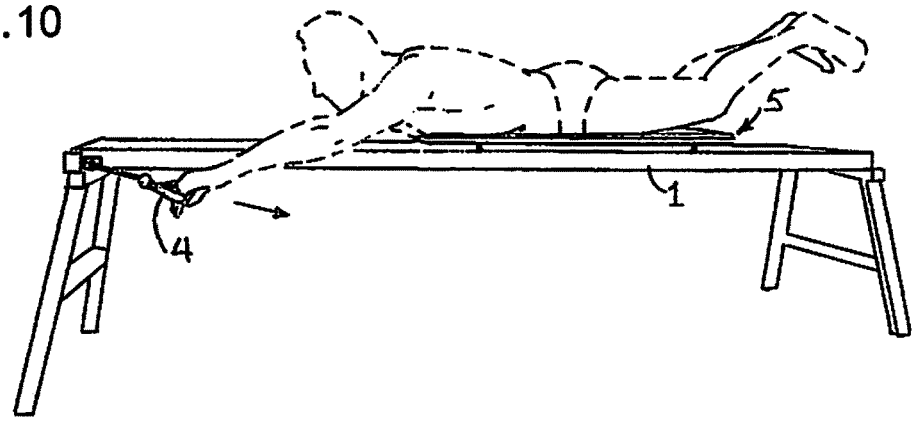
FIGS. 10 to 12 show sequential views of the apparatus of FIG. 1 in operation according to the direction arrows, wherein the user is at the initial position of a power stroke in FIG. 10, and then in the middle position of the power stroke in FIG. 11, and then at the end position of the power stroke in FIG. 12.

FIG. 1 shows an elongated solid platform 1 configured in accordance with the present invention. The platform 1 is elevated and supported at each end by a front leg assembly 2 and a rear leg assembly 3 that are hingedly connected to the platform. The leg assemblies and platform may be made of wood or metal or plastic or any other suitable materials or combination thereof. The leg assemblies are shown in their extended positions and may be held there by metal folding brackets or any suitable means, but then may be folded into a collapsed position for storage or transportation of apparatus A. FIG. 1 also shows each hand harness 4 located at each side of apparatus A near its forward end. Just before operating the apparatus, the user places a hand harness on each hand, such as shown in the expanded view in FIG. 16, and the hand harness construction is described later. FIG. 1 also shows a torso support 5 that the user's torso is positioned upon as shown in FIG. 10. The torso support is also shown in the expanded view of FIG. 17, and its construction will be described later.

Figure 2:
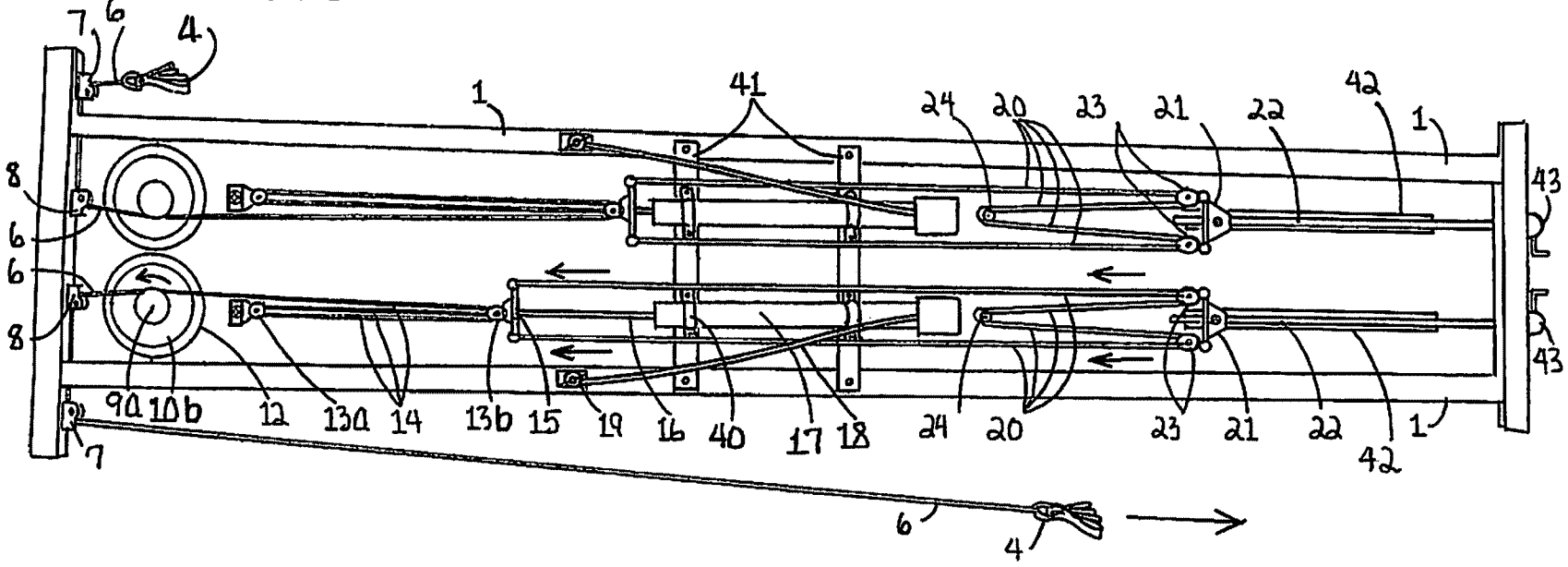
FIG. 2 is a plan view of the underside of the apparatus of FIG. 1 depicting a first preferred embodiment of the two cable systems of the invention mounted underneath the platform.
Figure 11:
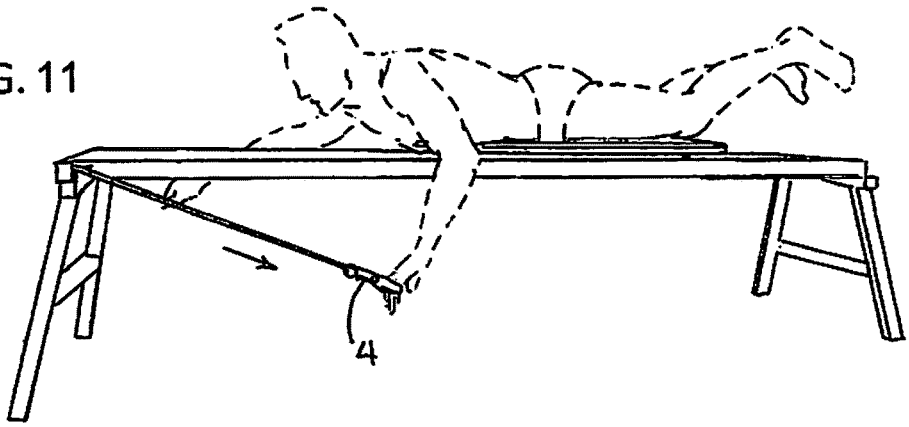
Figure 12:
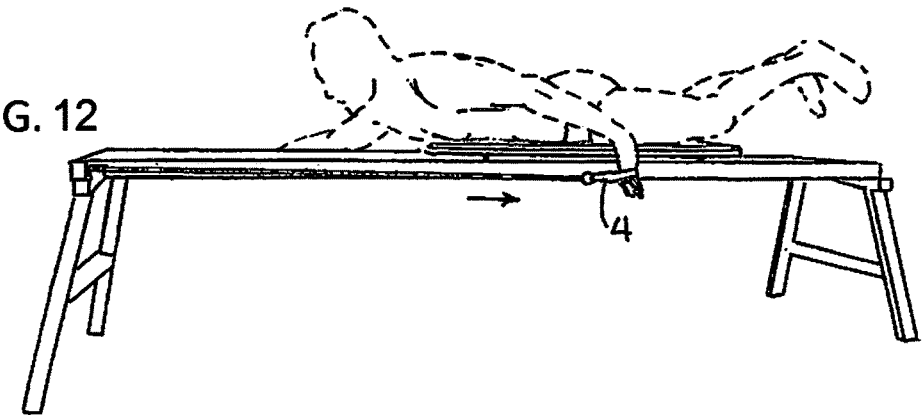
Figure 13:
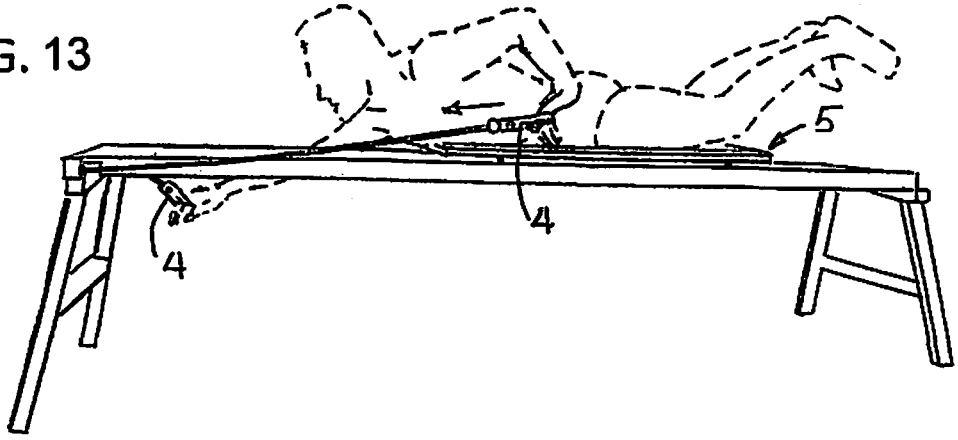
FIGS. 13 to 15 show sequential views of the apparatus of FIG. 1 in operation according to the direction arrows, wherein the user is at the initial position of a return stroke in FIG. 13, and then in the middle position of the return stroke in FIG. 14, and then at the end position of the return stroke in FIG. 15.
Figure 14:
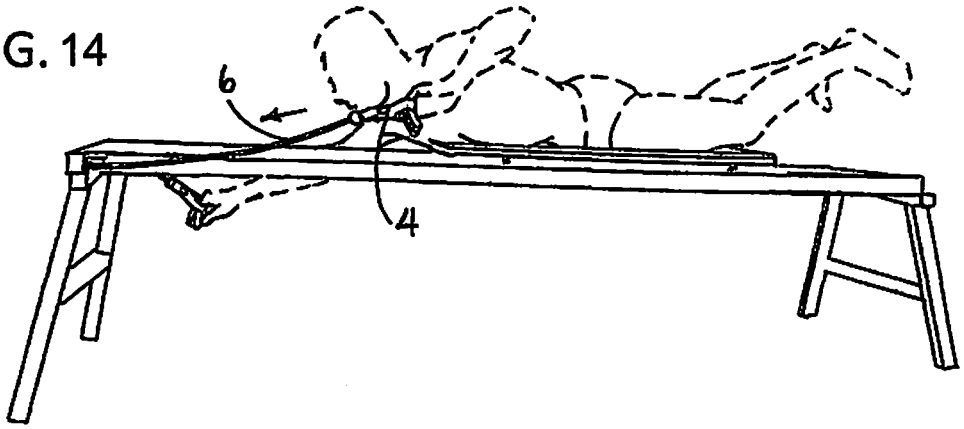
Figure 15:
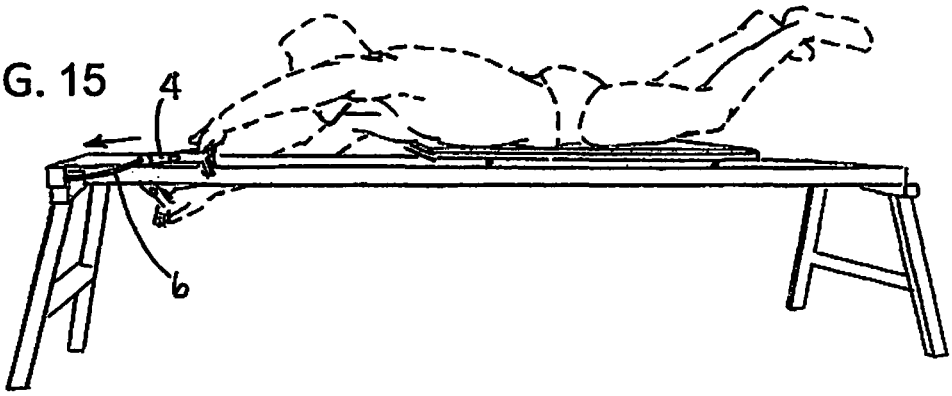

FIG. 2 shows matching cable systems of the present invention mounted to the underside of platform 1 (the hinged leg assemblies 2 and 3 are not depicted). Both cable systems generally operate independently of one another, but are designed as mirror images of one another and function similarly. Accordingly, the like structures and parts for the user's right-hand operated cable system and left-hand operated cable system will be referred to by like numerals. As the user simulates surfboard paddling on platform 1, each cable system goes through two modes of operation. The first mode of operation is during each of the user's power strokes while the user is pulling on either the right-hand or left-hand harness 4 as shown in FIGS. 10-12. The second mode of operation is during each of the user's return strokes while the user is returning either hand harness back to its original position on platform 1, as shown in FIGS. 13-15.

FIG. 2 shows that the means of resistance to the user's power strokes is provided by a primary elastic cord 20 included within each cable system. As the user pulls a hand harness 4, such as shown by the direction arrow extending axially from one of the two hand harnesses depicted, the leading cable 6 to which the hand harness is attached, is also pulled, which causes its respective primary elastic cord 20 to be stretched in the direction depicted by the four arrows shown beside the primary elastic cord as it resists the user's pull. Conversely, while either hand harness is being returned to its original resting position during a user's return stroke, the cable system for that respective right-hand or left-hand side provides a means for the user to experience zero tension and resistance from the primary elastic cord 20. That is because the cable system provides a slight amount of slack in the leading cable 6, as shown in FIGS. 14 and 15. And almost all such slack in the leading cable 6 will be gone by the time that the user's hand has returned to the start position for the next power stroke as depicted in FIG. 15. Either cable system can independently provide that effect regardless of how fast or slow the user pulls on the leading cable 6, or returns the leading cable back to its start position.

Figure 3:
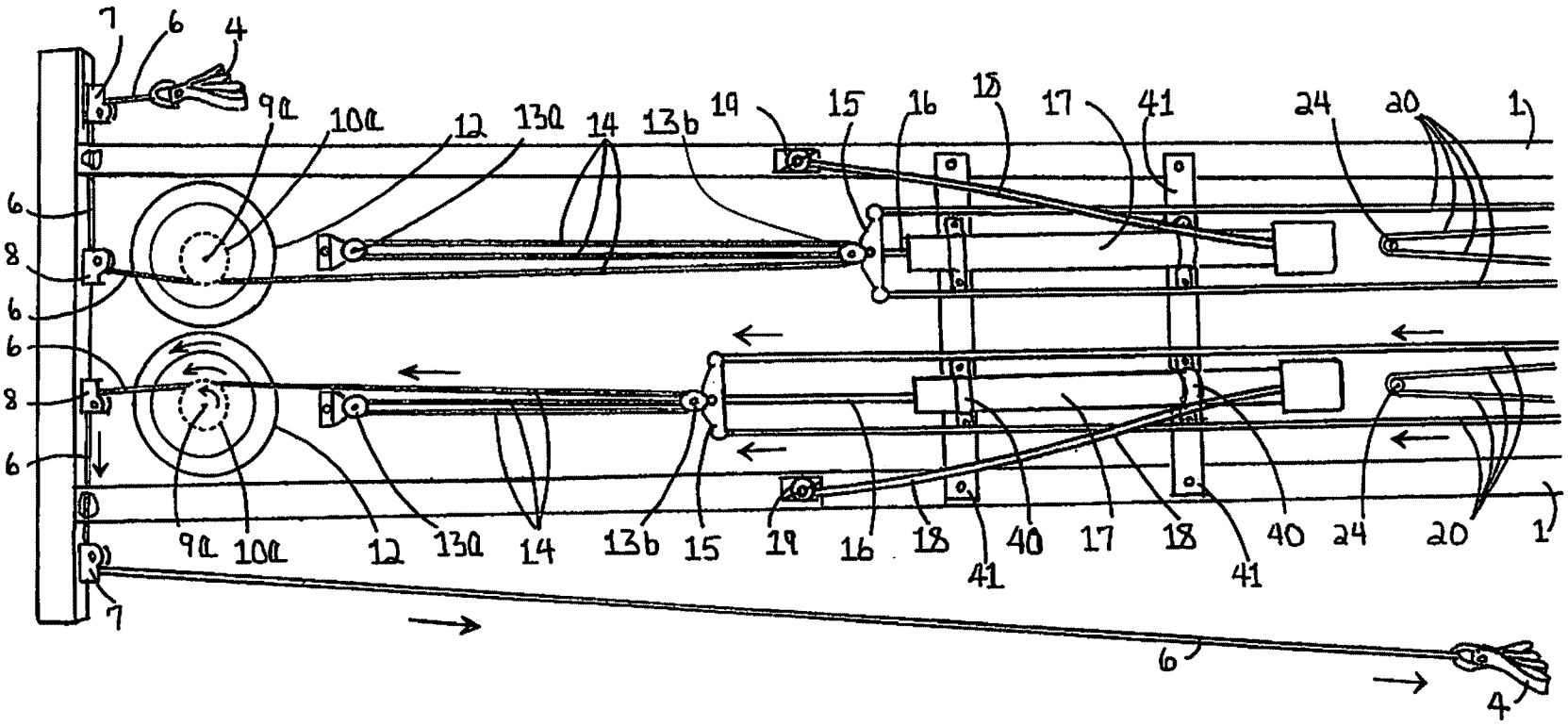
FIG. 3 is an expanded view of FIG. 2 depicting the main components of the cable systems, showing one cable system in motion according to the direction arrows, and the other cable system at rest.

FIG. 3 shows the main components of both cable systems, with one of the cable systems in motion during a user's power stroke according to the direction arrows, and the other cable system stationary at rest following a user's return stroke. FIG. 3 also shows that each leading cable 6 is threaded through its respective outboard pulley 7 and then is threaded through a passageway in the side frame member of platform 1, as depicted by the cutaway views at the ends of the frame members, and then the leading cable is threaded through its inboard pulley 8. The pulleys may be attached to the frame of platform 1 with screws or any suitable fasteners. After being threaded through each inboard pulley 8, each leading cable 6 takes an approximately ninety degree turn from the inboard pulley, and goes directly to its respective spool hub 10*a*. And the spool hub is also shown in FIG. 4.

Figure 4:
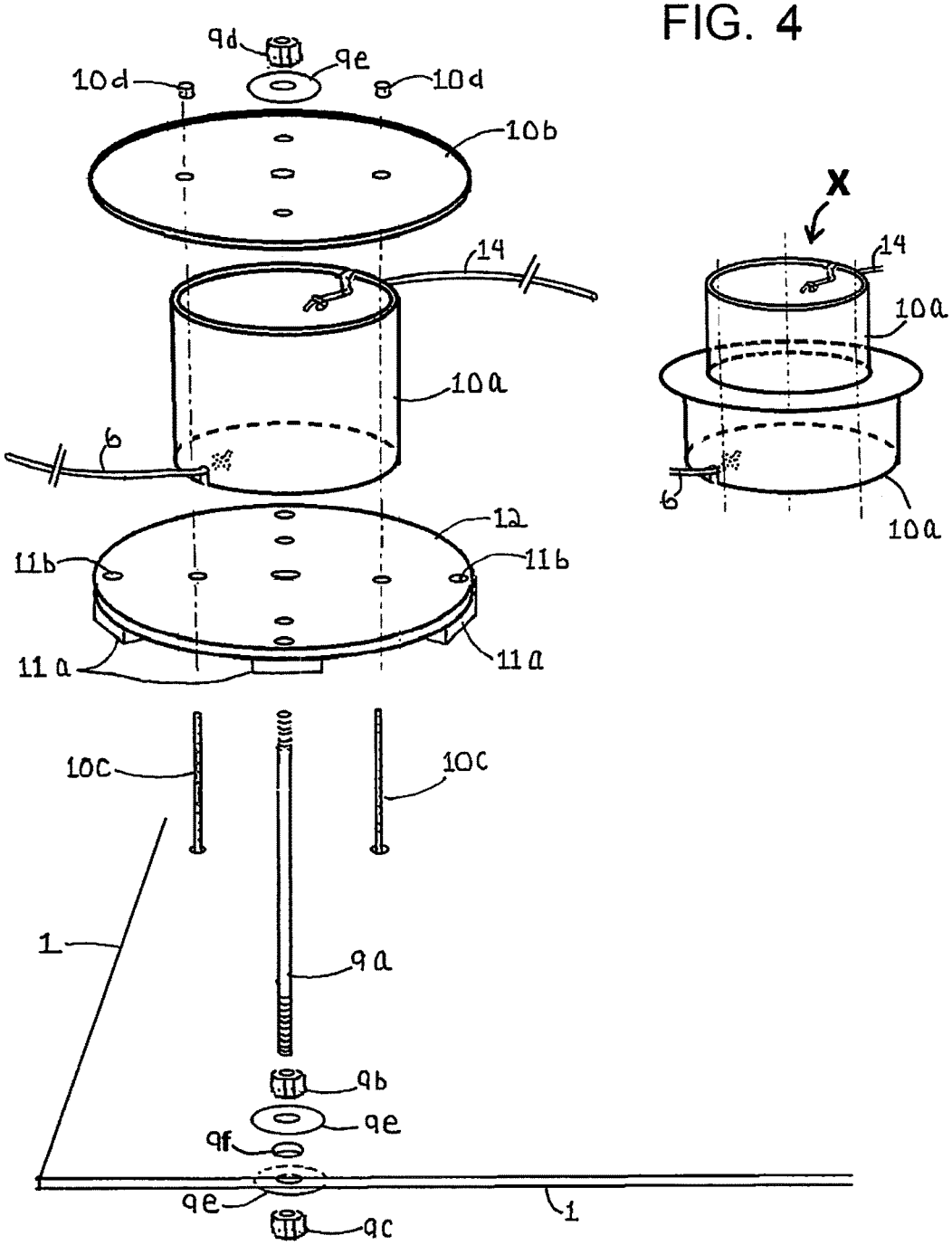
FIG. 4 is an exploded perspective view of a typical spool within each cable system, and shows an additional embodiment of the spool hub at X.

FIG. 4 shows how each spool is constructed for each cable system by using a hollow hub 10*a* that is made from a suitable material such as a short section of plastic pipe. The hub is centered upon and sandwiched between a top disc 10*b* and a bottom disc 12, and then secured in that position by a plurality of machine screws 10*c*, that extend entirely through the spool at locations just inside of the hollow hub, and that are then screwed into lock nuts 10*d*, so that the hub does not slip or rotate between the discs. The spool may be made from any suitable materials such as metal or plastic using cast or machined parts, and be held together by any suitable means, and the hub may be centered on the discs or held in place by grooves or lugs located in or on the cable spool.

Figure 5:
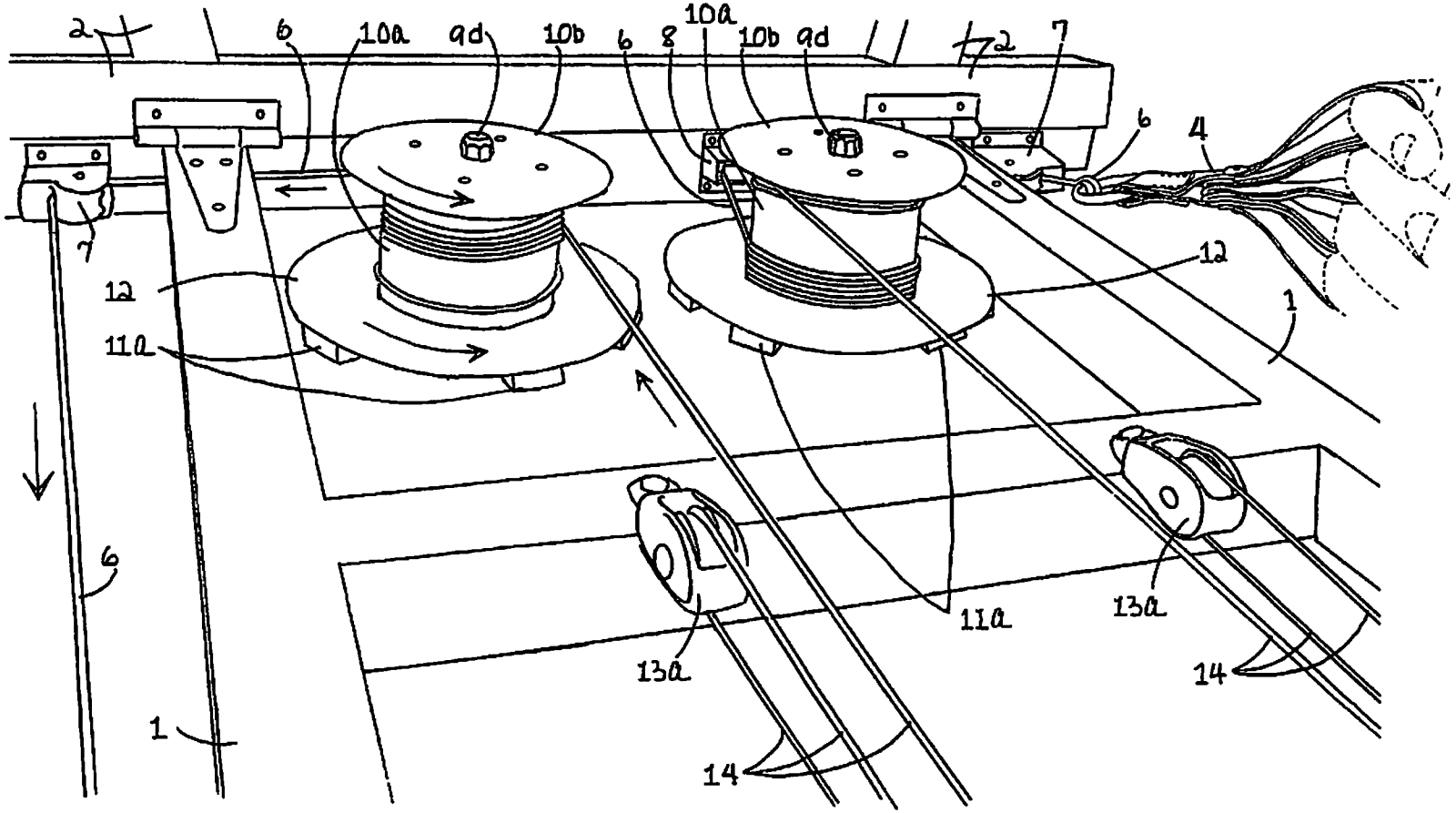
FIG. 5 is an expanded side perspective view depicting the spool assemblies within both cable systems, with leading and trailing cable segments wound around each spool.

When each spool has been fully assembled to include cable segments 6 and 14 as will be described, it is then rotatably mounted onto platform 1 by an axle bolt 9*a*, that is threaded at each end as shown in FIG. 4, and that extends through a hole 9*f* in the top surface of platform 1. The axle bolt 9*a* is inserted into hole 9*f* from the underside of platform 1. However before the axle bolt is inserted through hole 9*f*, the axle bolt lock nut 9*b*, and a fender washer 9*e*, are placed onto the end of the axle bolt that is then inserted through hole 9*f*. Then another fender washer 9*e*, and a cap nut 9*c*, may be placed onto the end of the axle bolt 9*a* that projects through the top surface of platform 1. The cap nut 9*c* is then fully tightened onto the end of axle bolt 9*a*. Then the axle bolt lock nut 9*b* is tightened down around the threads of the axle bolt to secure it on the platform in a protruding orientation to form a stable shaft for the spool to rotate upon as shown in FIG. 5. That leaves the cap nut 9*c* visible on the top surface of platform 1 as shown in FIG. 1. Each spool top disc 10*b* and bottom disc 12 has a hole at its center through which the axle bolt 9*a* extends, allowing the spool to be rotatably held on the axle bolt with a spool retaining nut 9*d*, and washer 9*e*, that are located on the other threaded end of the axle bolt 9*a* that protrudes through the top disc 10*b* of the cable spool.

FIG. 4 also shows that the hollow hub 10*a* has two holes or slots in its side wall. The cable leading segment 6 is inserted into one hole or slot, and the cable trailing segment 14 is inserted into the other hole or slot. Then the end of each cable segment is knotted, so that the cable segments are secured on the spool hub once the spool is fully assembled. Then the machine screws 10*c* are used to assemble the spool. Then the cable leading segment 6 is wound six times in a given direction around the spool hub 10*a*. Then the cable trailing segment 14 is wound one time around the spool hub 10*a* in the opposite direction as that of the cable leading segment. Then the spool assembly is ready to be placed on its axle bolt 9*a*, and secured with retaining nut 9*d*. In the present invention, the cable leading and trailing segments could as a variation be combined as a single continuous cable threaded through the spool hub, where the continuous cable enters into the hollow hub 10*a* as the cable leading segment, and is then knotted as described above or anchored to the spool hub, and then exits from out of the spool hub as the cable trailing segment. And the spool hub could also have openings of any shape for receiving or holding the cable segments.

Additionally, referring now to FIG. 4 at X, there is shown a variation of the spool hub 10*a*. In said variation, the spool hub comprises two different diameters wherein one portion of the hub 10*a* is larger in diameter for the cable leading segment 6 to wind around, and the other portion of the hub 10*a* is smaller in diameter for the cable trailing segment 14 to wind around. Then, when constructing the spool assembly as described previously, the cable leading segment is to be wound six times around the larger diameter portion of the hub in a given direction, and the cable trailing segment is to be wound once around the smaller diameter portion of the hub in the opposite direction. And during operation of the apparatus, both portions of the spool hub rotate in unison and on the same axis, so that when the spool rotates, the ratio of the travel of the cable trailing segment will be less than that of the cable leading segment. That difference in the ratio of cable travel provides a means to actuate a piston pump as will be described later.

FIG. 5 depicts the underside of apparatus A with both spools rotatably mounted onto their axle bolts and held in place with retaining nuts 9*d*, and shows the cable leading and trailing segments 6 and 14 wrapped around the spool hubs 10*a*. FIG. 5 also shows one cable system at rest, with its hand harness 4 returned to the start position, and with its cable leading segment 6 accordingly wound six times around that spool hub 10*a*, and with its cable trailing segment 14 wound once around that spool hub. The other cable system is shown in motion according to the direction arrows, and indicates that its cable leading segment 6 is being pulled during a power stroke and is unwinding from off of its spool hub by rotating the spool hub 10*a* through six revolutions, and that at the same time its cable trailing segment 14 is being reeled onto the spool hub 10*a* by those same six revolutions of the hub. That depicted motion shows the cable system first mode of operation during a power stroke.

In the second mode of operation of each cable system during a return stroke, the rotation direction of the spool reverses due to the structures and connections shown in FIGS. 2, 3 and 5. FIGS. 3 and 5 for example show that each cable trailing segment 14 goes through a set of block-and-tackle pulleys 13*a* and 13*b*, and that each block set of pulleys 13*a* is mounted to platform 1 in a fixed position, and that each tackle set of pulleys 13*b* is connected to each forward yoke 15, and that each forward yoke 15 is connected to each primary elastic cord 20. The forward yoke 15 may be made of sheet metal or any suitable material, and the tackle set of pulleys 13*b* may be attached to the forward yoke with screws or other suitable fasteners, but sheaves mounted in the forward yoke could alternatively function as the tackle set of pulleys. The forward yoke 15 is coupled to the ends of the primary elastic cord 20 with metal loops on the forward yoke into which the knotted ends of the primary elastic cord 20 are placed, but the primary elastic cord could alternatively be coupled to the forward yoke 15 by any other suitable means. FIG. 2 shows that each primary elastic cord 20 then goes from its connection on a forward yoke 15 to a rearward yoke 21 (and as will be described later, each rearward yoke 21 is adjustable by the user to alter the existing elastic force within the primary elastic cord 20). The result, as shown by the direction arrows in FIGS. 2 and 3, is that whenever a hand harness 4 is being pulled axially during the user's power stroke, that pulling motion is transmitted through the cable leading segment to rotate the spool which reels-in the cable trailing segment 14 causing the cable trailing segment to pull the tackle set of pulleys 13*b* toward the block set of pulleys 13*a*, which causes the tackle set of pulleys 13*b* to pull the forward yoke 15, which causes the forward yoke to pull on its respective primary elastic cord 20. Accordingly, whenever the user is pulling on a hand harness 4, the user is also indirectly pulling on and stretching the respective primary elastic cord 20 which resists the user's pull.

As also shown in FIG. 3, each cable system includes a piston pump 17, and each forward yoke 15 couples together not only the tackle set of pulleys 13*b* and each primary elastic cord 20, but also the piston rod 16 of each piston pump. The block-and-tackle pulleys reduce the sixty linear inches of cable leading segment travel produced by the reach of the user's arm motions during power strokes, down to about eighteen inches of closure between the block set of pulleys 13*a* and the tackle set of pulleys 13*b* to make it practical to employ a piston pump within the cable system. In order to do that, each cable trailing segment 14 is threaded between the block-and-tackle pulleys to produce a 3.5:1 mechanical advantage ratio. However as a variation of that design within the present invention, the mechanical advantage ratio could be produced by making the spool hub 10*a* with two different diameters as shown in FIG. 4 at X as described previously. The present invention therefore includes the principle of employing a mechanical advantage ratio as the means to transmit and reduce approximately sixty inches of cable travel produced by the user's arm strokes, down to a lesser amount of linear motion to make it practical to operate a piston pump. In accordance with that principle, the tackle set of pulleys 13*b* is coupled to the forward yoke 15 which is coupled in turn to the piston pump rod 16. That is done here by threading and screwing the end of the piston rod into a threaded nut on the forward yoke, but any suitable coupling means could be used. The result of that coupling, as depicted in FIG. 3 is that while a hand harness 4 is being pulled according to the direction arrows, the forward yoke 15 and the piston rod 16 to which it is coupled, are pulled outward from piston pump 17, while a one-way air valve operatively connected to the piston pump allows ambient air to enter into the pump chamber without restriction during the user's power stroke. Accordingly, since each piston pump 17 is held in place by straps 40 fastened to crossbars 41 that are fastened to the frame of platform 1, there is no significant resistance from the piston pump 17 while air is drawn into its chamber during the user's power stroke. However, during the user's return stroke, all aforementioned motion of the identified components is reversed because of the way that each forward yoke 15 links together the tackle pulleys 13*b* and piston rod 16 and primary elastic cord 20, so that during the user's return stroke, the piston rod is forced back into the pump chamber by the elastic force from the primary elastic cord which is transmitted through the forward yoke 15 to the piston rod which causes the piston pump 17 to push air out through the air hose 18, and through the relief valve 19, which relief valve can be pre-adjusted by the user to variably restrict the air exiting from the piston pump, thus causing the cable system and hand harness 4 to adjustably return to their starting positions more slowly.

The present invention includes not only fluid resistance from the piston pumps described previously to dampen the cycling speed of the cable system, but also includes mass moment of inertia, as will now be described, to dampen the cycling speed of the cable system, and both or either of such means as described may be used as part of the invention. The mass moment of inertia design of the invention, as shown in FIGS. 4 and 5, includes weights 11*a* that are attached proximate to the rotating perimeter of each spool to provide mass moment of inertia as the spool rotates during the user's power strokes. The weights 11*a* are attached with suitable fasteners through holes 11*b* as in FIG. 4, so that during the power strokes, the weights 11*a* rotate with the spool around its axle bolt 9*a*. But when the user begins a return stroke, the mass of the weights resists any sudden reversal of rotation direction being applied to the spool from the accumulated elastic force of the stretched primary elastic cord 20 that is being transmitted to each spool through its respective cable trailing segment 14 as described previously. Since the mass moment of inertia from the weighted spool resists that sudden reversal of rotation direction, that dampens the cable system's cycling speed in order to make the tension from the primary elastic cord 20 seemingly disappear to the user in the first few moments of a return stroke. The weights may be attached to or made a part of the spools and may be of any suitable material to provide a mass moment of inertia that is sufficient to significantly alter the cycling speed of the cable system as the user alternates from power stokes to return strokes, and the weights or mass may be located anywhere within the cable system and be rotated directly or indirectly by the travel of the cables as described here. And the positions or amounts of the mass may be adjustable manually or automatically to affect the mass moment of inertia during operation of apparatus A.

The present invention also provides a means for the user to adjust the pre-existing elastic force within each primary elastic cord 20 so that the elastic cord offers greater or lesser tension resistance to the user's power strokes. As shown in FIG. 2, either of the primary elastic cords may be set to a longer or shorter operating length by adjusting the position of either of the two rearward yokes 21 that serve as carriers to which the primary elastic cords 20 are linked. The rearward yokes are threaded onto threaded rods that are rotatably mounted on platform 1, so that the carriers move along the threaded rods 22 as the user turns either of the rods 22 using the elastic cord adjustment cranks 43 to move the rearward yokes 21 closer to or father from the forward yokes 15. Each rearward yoke has a pair of rearward yoke pulleys 23, through which each primary elastic cord 20 is threaded, after which each primary elastic cord 20 then goes to an elastic cord fixed anchor point 24 on platform 1. As the user turns either adjustment crank 43, thus moving the rearward yoke 21, that movement of the rearward yoke adjustment can be seen while standing over apparatus A and looking through inspection slots 42 that are cut through the top of platform 1. The rearward yokes may be made of sheet metal or any suitable material to provide suitable mounting points to which the rearward yoke pulleys 23 may be attached with suitable fasteners, or as an alternative, sheaves may be mounted into each rearward yoke 21 to serve the same purpose as the pulleys 23. Each rearward yoke 21 has a threaded nut or other suitable threaded receiver into which the threaded elastic cord adjustment rod 22 may be installed. As a variation, both primary elastic cords could simultaneously be adjusted by turning a single elastic cord adjustment crank, or within the principle of the design, such adjustment could be through a remote or motorized actuator, or by anchoring the elastic cords to alternative locations on apparatus A, or by adding or subtracting the number elastic cords, or by mechanisms to automatically coordinate the primary elastic cord adjustment with that of the relief valve 19 by the use of gears, or other suitable means.

Figure 6:
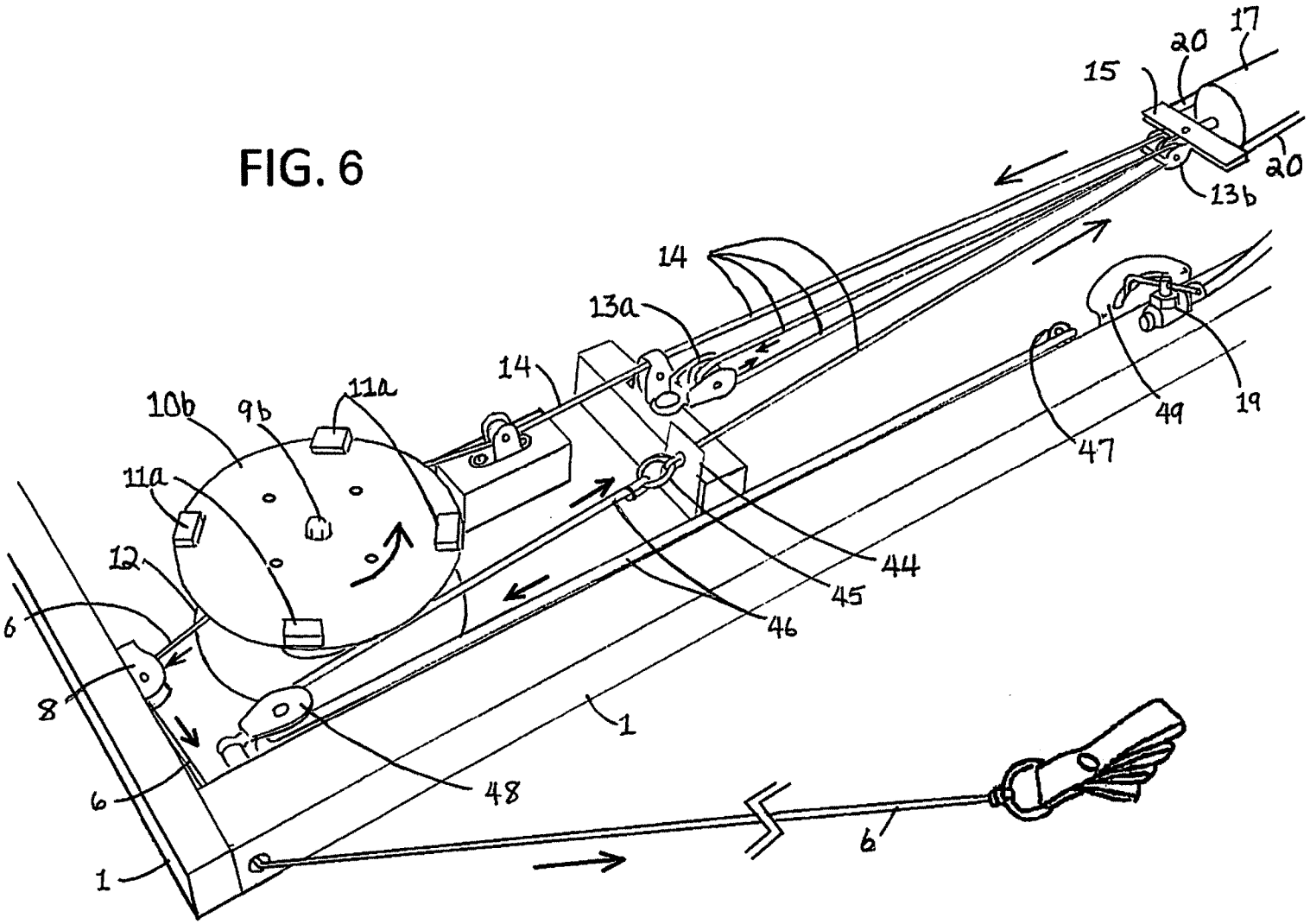
FIG. 6 is an expanded perspective view of a spool with a secondary elastic cord along side of the spool to take-up any excess cable slack.

FIG. 6 shows a means within the present invention to automatically take-up any excess slack in the cable leading and trailing segments 6 and 14 that might occur if the relief valve 19 is for example adjusted too restrictively. As depicted, the cable trailing segment 14, after being threaded through all block and tackle pulleys, then passes through a hole in the trailing cable end stop 44. The end stop may be made of metal or any suitable material, and mounted to platform 1 with suitable fasteners, and the hole in the end stop is just large enough to accommodate the cable diameter size. After passing through the hole in the end stop, the cable trailing segment end is then coupled to a link 45 to which a secondary elastic cord 46 is also coupled. After coupling to link 45, the secondary elastic cord 46 is threaded through the secondary cord pulley 48, and the secondary elastic cord then goes from that pulley to an anchor point 47 that is attached to the frame of platform 1. The secondary elastic cord then provides relatively weak, but continuous, tension on the end of the trailing cable to take-up any excess slack. As a variation, the cable end stop 44 and link 45 may be placed on the opposite side of the sheave of pulley 48. The relief valve adjustment dial 49 is depicted as an example of a means to restrict the range of air valve adjustment.

Figure 7:
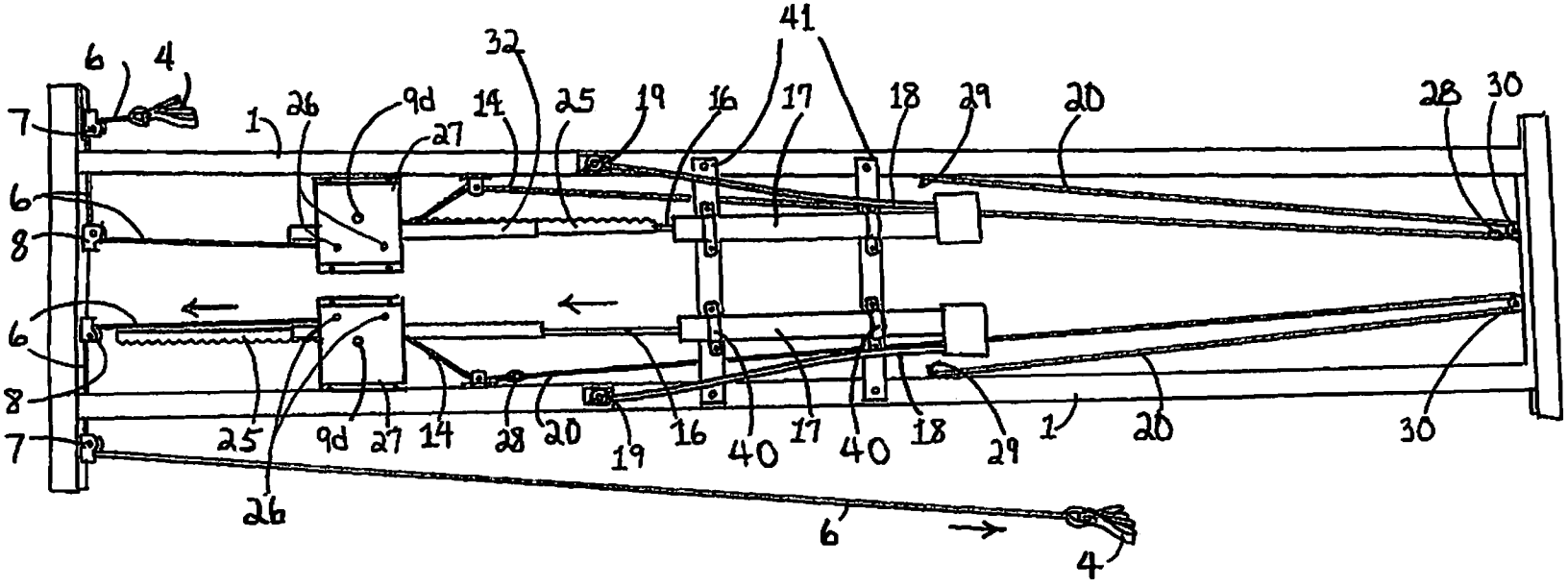
FIG. 7 is a plan view of the underside of the apparatus of FIG. 1 depicting a second preferred embodiment of the two cable systems of the invention.
Figure 8:
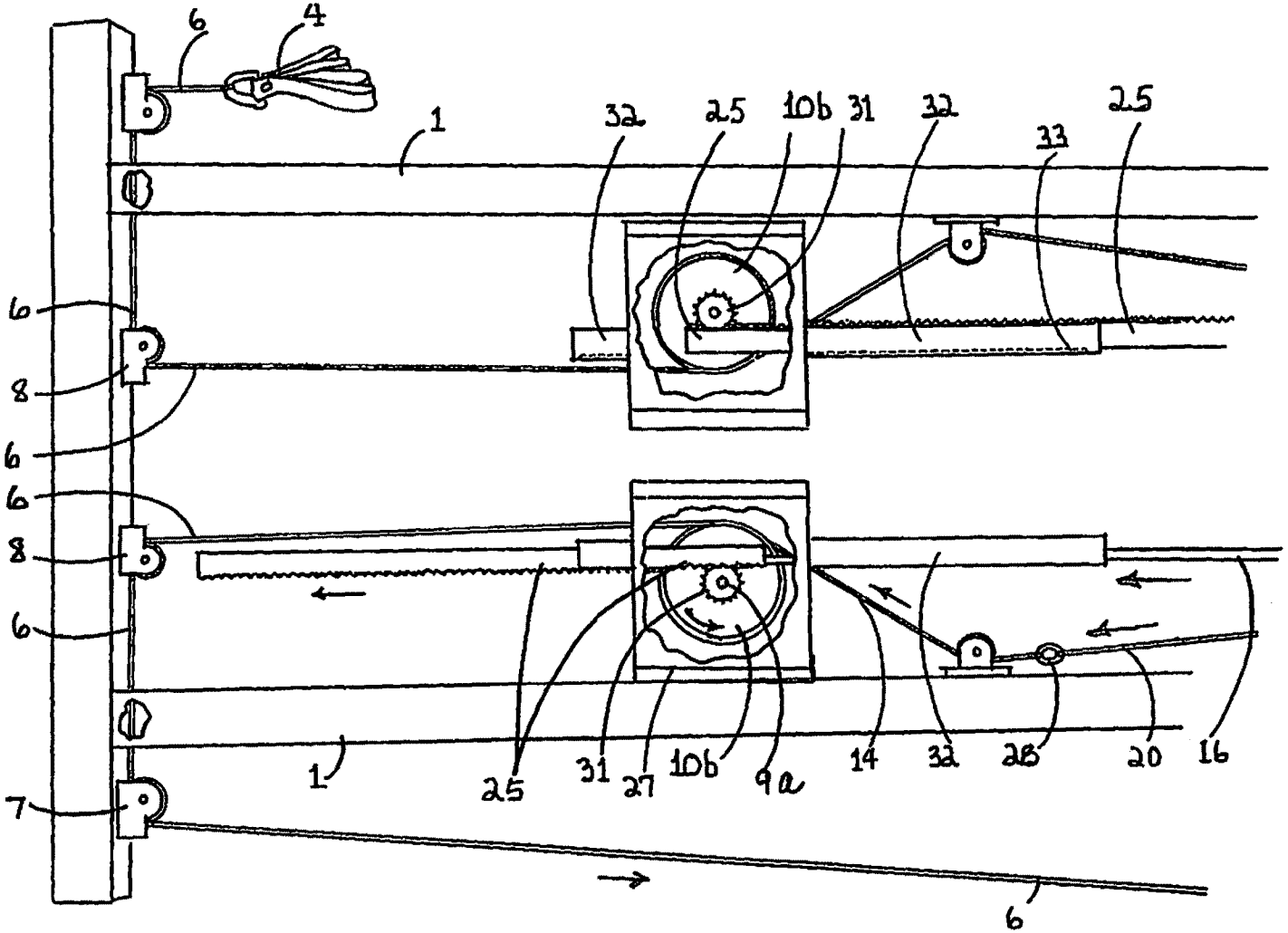
FIG. 8 is an expanded perspective of FIG. 7 depicting cutaway views, and showing one cable system in motion according to the direction arrows, and the other cable system at rest.
Figure 9:
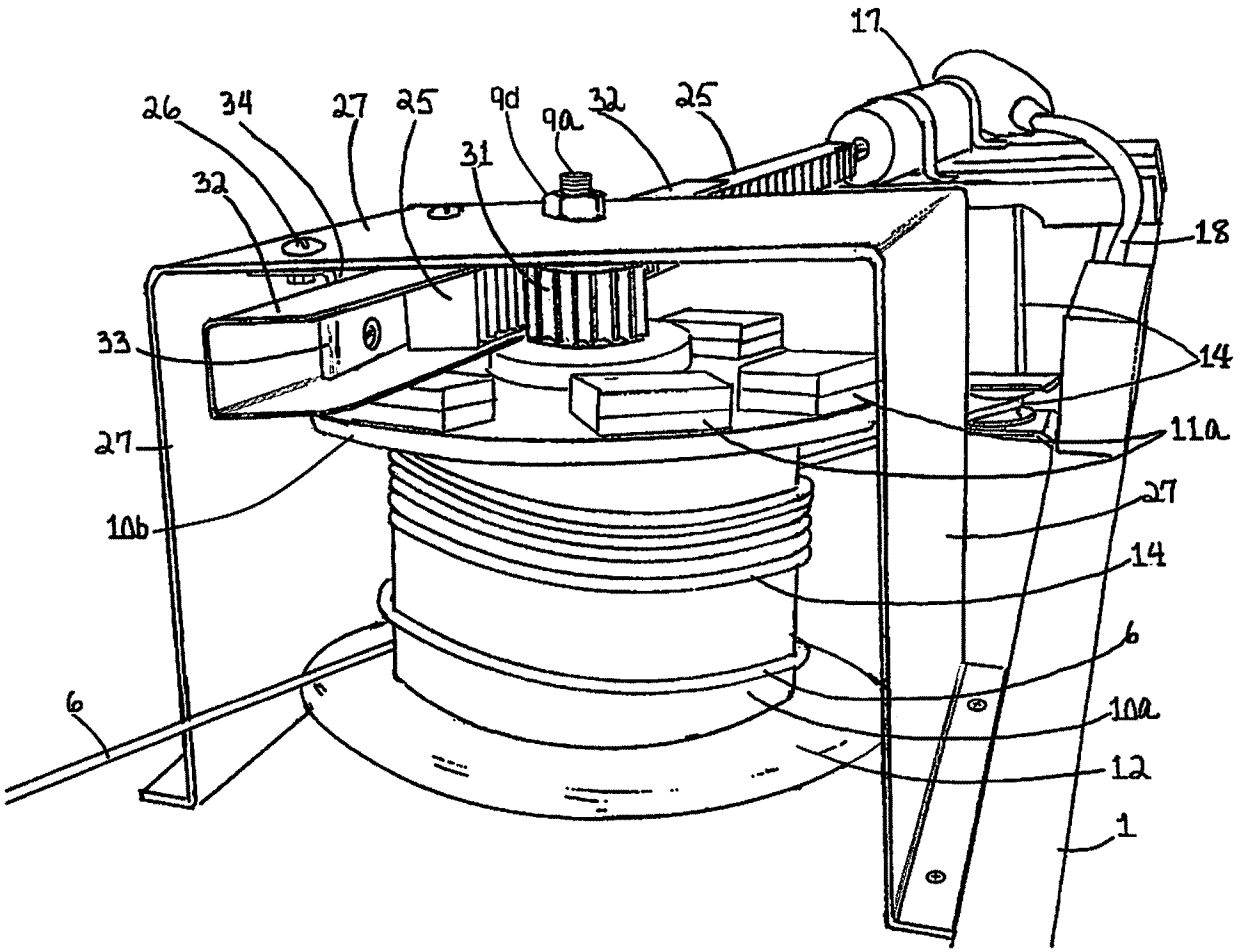
FIG. 9 is an expanded side perspective view of the spool shown in motion in FIG. 8.

FIGS. 7-9 show another embodiment of apparatus A that is structured in accord with the principles of the present invention, wherein the cable systems are generally similar to those in FIGS. 2 and 3. Accordingly, the like parts and structures of both embodiments will be referred to by like reference numerals. As shown by the cutaway views in FIG. 8, a set of rack and pinion gears 25 and 31 is used for the same purpose of reducing about sixty inches of cable leading segment travel down to approximately eighteen inches of linear motion for actuating the piston pumps. FIG. 9 shows how each pinion gear 31 and gear rack 25 mesh together due to the gear rack guide 32 mounted in the spool bracket 27 using a gear rack guide mounting bracket 34 that is fastened to the spool bracket with screws 26. The spool bracket 27 is fastened to the underside of platform 1 and the gear rack guide 32 slidably holds the gear rack 25 against the pinion gear 31, allowing the gear rack 25 to slide in a linear manner upon the gear rack bearing insert 33 that is made of any suitably low-friction material, and which is fastened into the gear rack guide using screws with countersunk heads. The pinion gear 31 is coupled to the top disc 10*b* of the spool, here using set screws, and rotates in unison with the spool hub 10*a* on the same axle bolt 9*a* that is attached to platform 1 as described previously. The result, as in the first embodiment, is that during a power stroke the spool rotates. And according to the rotation direction arrow in FIG. 8, that spool rotation causes the pinion gear 31 to rotate, which causes the gear rack 25 to move in a linear direction toward the inboard pulley 8. Then during the user's return stroke, the motion of the spool and pinion gear and gear rack will be reversed due to the elastic force from the primary elastic cord 20 as in the first embodiment of the invention. FIG. 8 also shows that each gear rack 25 is coupled to the end of each piston rod 16. Here, that is done by drilling and tapping the end of each metal gear rack to accept the threaded end of each piston rod 16, but any suitable material and coupling means could be used. As shown by the direction arrows in FIG. 7, during a user's power stroke, the gear rack 25 pulls the piston rod 16 of the piston pump 17, causing the pump to draw ambient air into its chamber. Then, during the user's return stroke, the elastic force from the primary elastic cord 20 causes the spool and pinion gear and gear rack to reverse direction, which pushes the piston rod 16 into piston pump 17 and which forces the air out of the pump into the pump air hose 18 and relief valve 19. In this embodiment of the invention per FIG. 7, each cable trailing segment 14 may, as a variation, go directly from its cable spool hub 10*a*, through a link 28 to the primary elastic cord 20, and the opposite end of the primary elastic cord 20 may be anchored to the frame of platform 1 by a pin 29 that may be placed into various locations along on a notched rack, or the like, on platform 1, and elastic cord transom pulleys 30 may be used to extend the operating length of the elastic cords 20. Other parts shown numbered in FIGS. 7 through 9 are the same parts providing the same functions as those described previously for the first embodiment of the invention.

Figure 16:
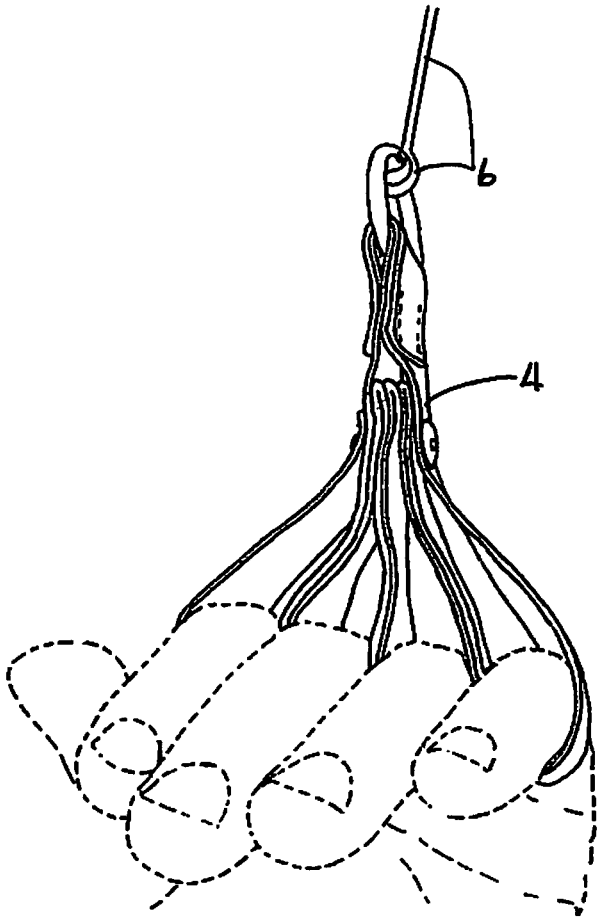
FIG. 16 is an expanded view of one of the hand harnesses shown in FIG. 1.

FIG. 16 depicts the design for each hand harness 4 that is coupled by any suitable means to each leading cable 6. The hand harness is not designed to provide, or attribute, any significant conditioning or developing of muscles found in the region beyond the user's forearms, but is instead designed to easily remain on the user's hand while the user is exercising on the apparatus A. Within the context of this application, the "hand harness" is defined as a device that provides at least one flexible loop into which one or more of the fingers of a person's hand may be snuggly inserted, and although there could be one or more of such finger loops provided, the ideal is that an individual finger loop is provided for each one of the user's four fingers on the hand, so that while the hand harness is on the hand it will not tend to slip off even when the hand is inverted in any position, and so that the user may comfortably cup the hand while pulling on leading cable 6 as when paddling a surfboard. The hand harness design of the present invention may be made from one length of strap formed into finger loops that are then riveted together at their top ends as depicted, and with one last loop over a "D" ring with a lap joint that can be sewn or glued over the "D" ring. However, the hand harness 4 of the present invention may as a variation be constructed from any flexible material or webbing, or made by molding or forming the hand harness from rubber or flexible plastic or the like, or by making the hand harness from more or fewer parts, or by holding it together or attaching it to a cable by any suitable means.

Figure 17:
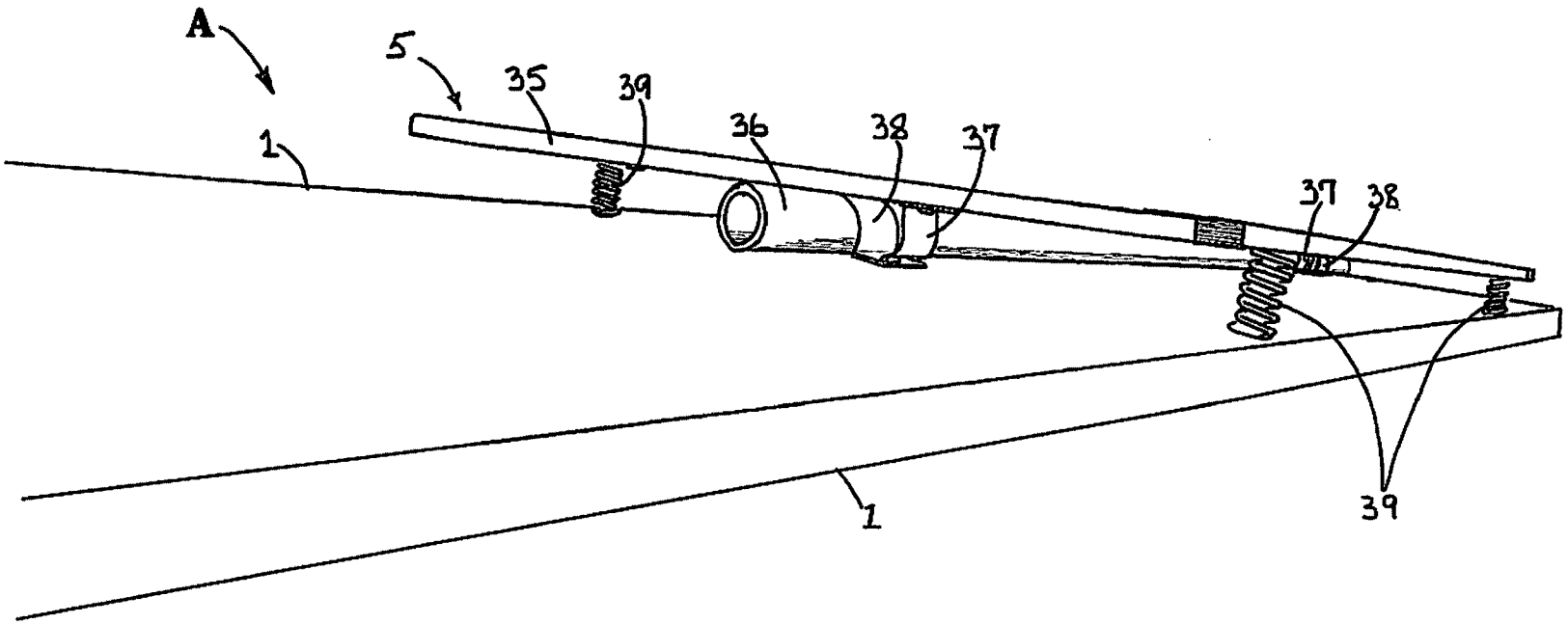
FIG. 17 is an expanded view of the torso support shown in FIG. 1.

FIG. 17 depicts the torso support 5 of apparatus A, and within the context of this application, the "torso support" is defined as a plate 35 that may be made from any suitable material such as plywood, and that may be padded with any suitable material such as foam, and the torso support is designed to be suitably large enough to primarily support only the user's mid to lower torso and upper legs as shown in FIG. 10. The torso support may be mounted on platform 1 by a means that allows the user's body to tilt side to side with the torso support during operation of apparatus A. Plate 35 is accordingly mounted on the elongate center line of platform 1 to the top surface of the platform over a length of round pipe, or the like, serving as an axle 36 that is centered under plate 35 and rotatably held onto the top surface of platform 1 by straps 37 and 38 at the forward and rearward ends of axle 36. The tilting movement of plate 35 is subject to a plurality of compression springs 39, or the like, mounted proximate to and between the side edges of plate 35 and the top surface of platform 1. As variations within the invention, the springs could be made of other alternative elastic materials such as rubber blocks, and the user may add or remove such elastic elements to compensate for user body weight in order to best simulate the challenge of remaining balanced on a tilting buoyant surfboard.

The principles of the present invention may be adapted to the construction of a variety of other embodiments, and alternative sizes or shapes or locations or numbers or orientations or materials of the components depicted and described above may also be used without departing from the scope of the present invention. It is believed that the disclosure set forth above encompasses multiple distinct inventions with independent utility. While each of these inventions have been disclosed in their preferred forms, the specific embodiments thereof as disclosed and illustrated herein are not to be considered in a limiting sense as numerous variations are possible. The subject matter of the inventions described and depicted above includes all novel and non-obvious combinations and sub-combinations of the various elements, features, functions and/or properties disclosed herein. No single feature, function, element or property of the disclosed embodiments is essential to all of the disclosed inventions herein. Similarly where the claims recite "a" or "a first" element or the equivalent thereof, such claims should be understood to include incorporation of one or more such elements, neither requiring nor excluding two or more such elements. Inventions embodied in other combinations and sub-combinations of features, functions, elements and/or properties may be claimed through amendment of the present claims or presentation of new claims in this or a related application. Such amended or new claims, whether they are directed to a new invention or directed to the same invention, whether different, broader, narrower or equal in scope to the original claims, are also regarded as included within the subject matter of the inventions of the present disclosure.

What is claimed is:

1. An exercising apparatus characterized by:

a. a supporting structure including at least one cable system with at least one spool that is rotated by cable system motion during operation of the apparatus;

b. the cable system comprising cable with a free-end upon which an axial pull is exerted by a person using the apparatus;

c. the cable system comprising a cable-end connected to at least one mechanical advantage mechanism so that the axial pull on the cable free-end is conveyed as motion through the cable system to operate the mechanical advantage mechanism;

d. the mechanical advantage mechanism converts the amount of motion input from the axial pull on the cable free-end to a reduced amount of motion output;

e. the motion output from the mechanical advantage mechanism is conveyed to at least one fluid pump, so that the operation of the mechanical advantage mechanism is linked to the operation of the fluid pump;

f. at least one elastic element is operatively connected to the cable system, so that when said cable free-end is pulled, the elastic element resists the pull;

g. the cable system comprises sufficient mass to produce an inertia force within the cable system equal in amount to a moment of inertia of at least thirty Ounce-Inch Squared (30 oz-In$^2$) while the cable of the system is in motion due to a pull on said cable free-end.

2. The apparatus of claim 1, wherein said fluid pump is operatively connected to an adjustable relief valve, so that the pump draws a fluid into the pump when the cable free-end is pulled, and then expels the fluid through the relief valve when the cable Is released.

3. The apparatus of claim 1, wherein the cable system includes a leading segment of cable having said free-end and another end coupled to a rotatable spool, and a trailing segment of cable having an end coupled to said rotatable spool and another end coupled to the mechanical advantage mechanism, and each cable segment winds around the rotatable spool so that an axial pull on the free-end of the cable leading segment causes the spool to rotatably reel-in the cable trailing segment to operate said mechanical advantage mechanism.

4. The apparatus of claim 1, wherein said mechanical advantage mechanism Includes at least one rotatable spool with sheaves of different diameters around which the cable of the cable system winds, and the sheaves rotate in unison with the rotatable spool during operation of the cable system to reduce the amount of motion output to the fluid pump.

5. The apparatus of claim 1, wherein said mechanical advantage mechanism includes a plurality of sheaves around which and between which the cable of the cable system Is threaded to reduce the amount of motion output to the fluid pump.

6. The apparatus of claim 1, wherein said mechanical advantage mechanism Includes at least one set of rack-and-pinion gears operatively connecting said cable of the cable system to said fluid pump to reduce the amount of motion output to the fluid pump.

7. The apparatus of claim 1, wherein said supporting structure comprises a platform with legs to elevate it into a generally horizontal position above a floor, and a torso support assembly that is able to tilt side to side on the platform while supporting the torso of the person using the apparatus.

8. The apparatus of claim 1, wherein said cable free end is coupled to a hand harness for engaging to the hand of a person using the apparatus, and said hand harness comprises at least one flexible loop that can fit closely around at least one of the fingers on the hand of the person.

9. The apparatus of claim 1, wherein said elastic element comprises at least one elastic cord that extends around at least one sheave.

10. The apparatus of claim 1, wherein the existing tension of said elastic element may be varied by an adjustable tensloner to alter the amount of elastic force exerted by the elastic element upon the cable system.

* * * * *